US005884588A

United States Patent [19]

Ap et al.

[11] Patent Number: 5,884,588

[45] Date of Patent: Mar. 23, 1999

[54] ENGINE COOLING SYSTEM WITH A THERMALLY INSULATED FLUID RESERVOIR

[75] Inventors: Ngy Srun Ap, St. Remy les Chevreuse; Philippe Jouanny, Maurepas, both of France

[73] Assignee: Valeo Thermique Moteur, Le Mesnil-Saint Denis, France

[21] Appl. No.: 853,122

[22] Filed: May 8, 1997

[30] Foreign Application Priority Data

May 10, 1996 [FR] France ..... 96 05869

[51] Int. Cl.[6] ..... F01P 11/02

[52] U.S. Cl. ..... 123/41.14

[58] Field of Search ..... 123/41.14

[56] References Cited

U.S. PATENT DOCUMENTS 1,863,437 6/1932 Collier .
2,016,179 10/1935 Rosenqvist .
2,054,525 9/1936 Simmen .
4,793,403 12/1988 Vataru et al. ..... 123/41.14

FOREIGN PATENT DOCUMENTS 746011 3/1933 France ..... 123/41.14
2 713 279 6/1995 France .
2363686 6/1975 Germany ..... 123/41.14
32 153 42 10/1983 Germany .

*Primary Examiner*—John Kwon
*Attorney, Agent, or Firm*—Morgan & Finnegan, LLP

[57] ABSTRACT

The cooling circuit of an internal combustion engine of a vehicle includes a thermally insulated reservoir having an inlet duct and an outlet duct. These ducts are connected to the mass of air in a head space either within the expansion vessel in the cooling circuit or within the reservoir itself, in such a way that the inlet and outlet ducts become filled with air when the motor is stopped. This air then physically separates the liquid in the reservoir from that contained in the rest of the circuit, so reducing heat losses.

8 Claims, 2 Drawing Sheets

ENGINE COOLING SYSTEM WITH A THERMALLY INSULATED FLUID RESERVOIR

FIELD OF THE INVENTION

This invention relates to a system for cooling a heat engine, in particular a motor vehicle engine, more particularly the system being an apparatus comprising an extraction device, such as a heat exchanger, for taking heat from a heat transfer fluid, means also are provided for circulating the heat transfer fluid in a circuit which passes through the engine and the extraction device, the circuit including a thermally insulated reservoir for the fluid, the reservoir having an inlet duct and an outlet duct, and the like.

BACKGROUND OF THE INVENTION

An apparatus of the above kind is described in French patent specification No. FR 2 713 279A. This known apparatus enables the rate at which the temperature of the engine is raised to its working temperature to be increased after a period during which the engine is stopped, when the temperature of the heat transfer fluid contained in the reservoir is still at a relatively high temperature at the time when the engine is restarted. However, although the thermal insulation on the reservoir reduces heat losses to the surrounding atmosphere, and even when valves, which are disposed on either side of the reservoir, prevent any heat transfer by convection between the coolant fluid contained in the reservoir and that contained in the circuit close to the reservoir, transfer of heat, by conduction across the above mentioned valves, remains possible within the fluid.

DISCUSSION OF THE INVENTION

An object of the invention is to overcome the above mentioned drawbacks, and to provide a supplementary barrier in regard to heat losses from the reservoir to the environment of the latter.

According to the invention, a cooling apparatus for a heat engine, especially for a motor vehicle engine, comprises an extraction member, in particular a heat exchanger, for taking heat from a heat transfer fluid, together with means for circulating the heat transfer fluid in a circuit passing through the motor and the extraction device. The circuit has a thermally insulated reservoir for containing the heat transfer fluid, the reservoir having an inlet duct and an outlet duct. These ducts are characterised in that the inlet and outlet ducts are connected to a head space permanently containing air, whereby, when the flow of fluid in the circuit is interrupted, air from the head space becomes interposed in the ducts between the heat transfer fluid in the liquid state, contained in the insulated reservoir, and that which is contained in the remainder of the circuit.

Thus, since air is a much worse conductor of heat than liquids, the slugs of air which are formed in the inlet and outlet ducts delay the loss of heat from the liquid contained in the reservoir to that which is contained in the remainder of the circuit.

According to a preferred feature of the invention, the inlet and outlet ducts are in communication with each other through a passage or orifice which is narrow enough to avoid any significant disturbance of the flow of fluid in the circuit. A first one of the ducts being connected to the head space, the passage or orifice enabling air to be introduced into the second one of the ducts through the first duct.

The inlet and outlet ducts are preferably juxtaposed to each other, with a small passage or orifice being provided between them to bring the ducts into communication with each other. The first duct is preferably the inlet duct.

According to a further feature of the invention, the head space (or expansion space) is disposed in an expansion vessel which is part of the circuit and which is separate from the reservoir, the inlet and outlet ducts being disposed at least partly above the level of liquid in the expansion vessel.

In preferred embodiments of the apparatus in which the said first duct is the inlet duct, the expansion vessel is above the level of liquid within the reservoir, and is in direct communication with the inlet duct, the outlet duct extending down into the liquid within the reservoir, and the passage or orifice being located above the liquid level.

According to yet another preferred feature of the invention, the reservoir comprises a vessel having a thermally insulating wall with a top aperture which is sealingly closed by a plug. The inlet and outlet ducts are fixed to the plug and extend substantially vertically through the aperture. In preferred embodiments of this arrangement, flow distributing means, carried by the plug, are arranged to put the reservoir out of circuit so as to diminish the quantity of fluid flowing in the circuit under certain operating conditions of the apparatus.

Further features and advantages of the invention will appear more clearly on a reading of the following detailed description of some preferred embodiments of the invention, which is given by way of non-limiting example only and with reference to the accompanying drawings.

BRIEF DESCRIPTION OF THE DRAWINGS

FIG. 2 shows the reservoir by itself, in a second embodiment of the invention.

FIG. 3 shows the reservoir by itself in a third embodiment of the invention.

FIG. 4 shows the reservoir by itself in a fourth embodiment of the invention.

DESCRIPTION OF PREFERRED EMBODIMENTS OF THE INVENTION

Figure 1:
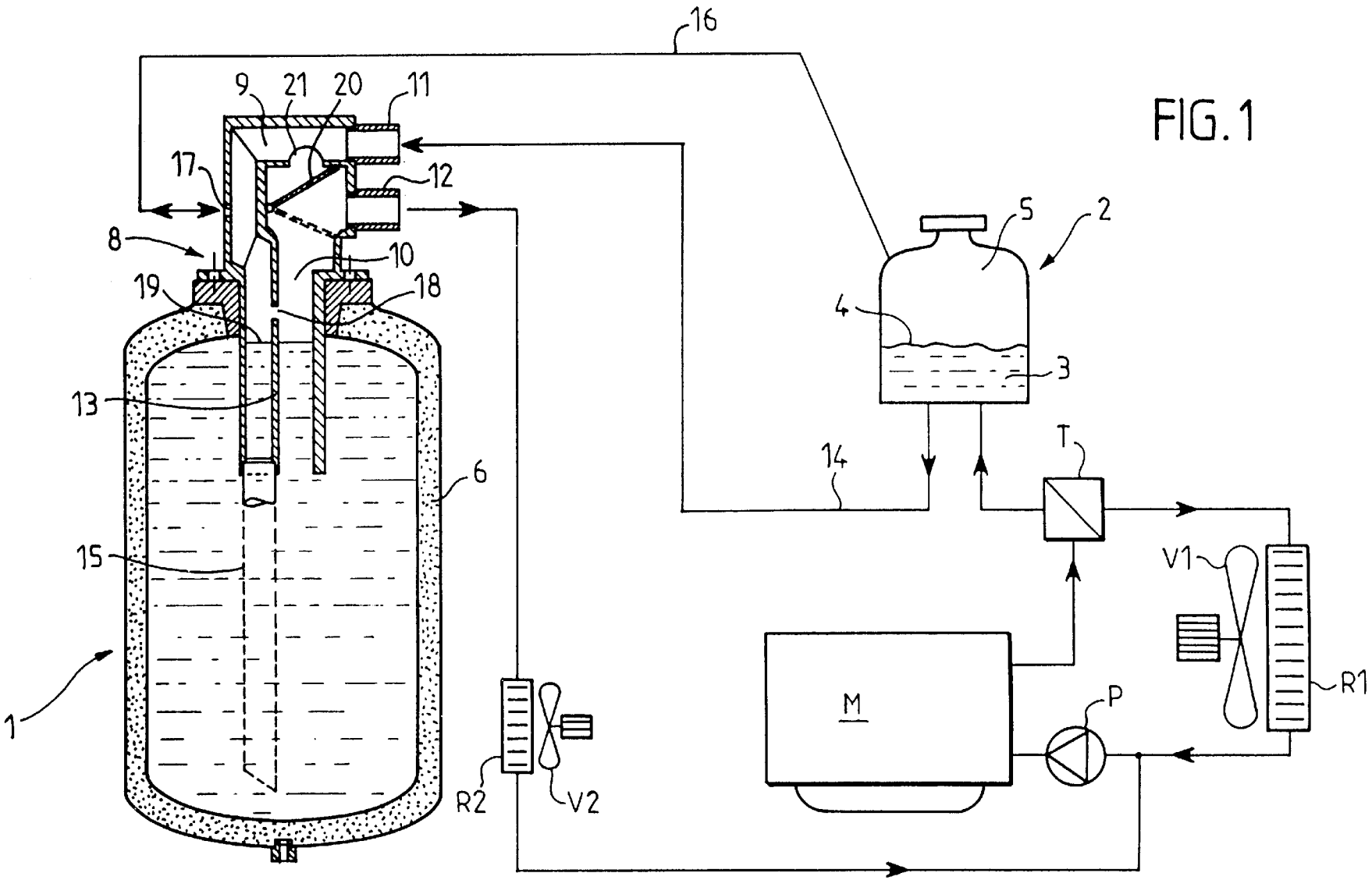
FIG. 1 is a fluid circuit diagram for an apparatus in accordance with the invention, including a side elevation in diametrical cross section of a reservoir in a first embodiment of the invention.

In the drawings, those elements which are identical or similar to each other are indicated in all of the Figures by the same reference numerals.

Referring first to FIG. 1, this shows two components of the cooling circuit for the engine of a motor vehicle, namely a thermally insulated reservoir 1 and an expansion vessel 2. The expansion vessel 2 is a conventional component of such a fluid circuit, and consists of a flask or bottle containing the coolant fluid 3 in the liquid state, with which the vessel 2 is filled up to a level 4. Above the level 4 is a head space 5 which contains air.

The function of the insulated reservoir 1, as is described in detail in the French patent specification cited earlier herein, is to keep hot a certain volume of coolant fluid when the engine of the vehicle is stopped so that the fluid is no longer flowing. In this way, after the engine has been started once again, it can be brought to its working temperature more quickly. In this example the reservoir 1 is in the form of a double-walled vacuum flask, the gap 6 between the two walls being evacuated. The flask 1 is oriented with its longitudinal or axial direction extending vertically.

At its upper end the flask 1 has an aperture which is sealingly closed by a removable plug 8. Two ducts 9 and 10 extend through the plug 8 at their upper ends. Outside the flask 1, the ducts 9 and 10 terminate in pipe connections 11 and 12 respectively, with the lower ends of the two ducts extending into the internal space within the flask 1. In the portions of the ducts 9 and 10 within the plug 8, and in their portions which extend into the flask 1, the two ducts are disposed vertically side by side, being separated from each other by a thin wall 13.

The expansion vessel 2 is connected in a pipe 14 which leads from the engine M of the vehicle, via a thermostat T, to the pipe connection 11, so that the fluid heated by the engine is passed into the duct 9, which is therefore the inlet duct of the insulated reservoir 1. The thermostat T enables a fraction of the fluid leaving the engine to be diverted, according to its temperature, into a cooling radiator R1 associated with a fan V1. The pipe 14 penetrates into the expansion vessel 2, and leaves through the bottom of the latter, so that the fluid from the engine mixes with the mass of cooled liquid 3 in the expansion vessel from which the liquid passed through the downstream part of the pipe 14 to the inlet duct 9 of the reservoir 1 is taken.

The ducts 9 and 10 form, with the plug 8, a single block, or plug unit. The two ducts 9 and 10 extend down to a common level within the internal space in the reservoir 1, though the inlet duct 9 may optionally be extended further by means of an attached tube 15, the lower end of which is close to the base of the reservoir. In either case, the fluid arriving through the inlet duct 9 is mixed with the mass of liquid with which the reservoir is filled, and the liquid leaves the reservoir via the outlet duct 10 and outlet connection 12, from which it is taken to a radiator R2 for heating the cabin of a vehicle. A fan V2 is associated with the heating radiator R2. After the liquid has passed through the heating radiator R2, it rejoins that which has just left the engine cooling radiator R1, the total flow being returned to the engine M by a pump P.

The head space 5 in the expansion vessel 2 is connected, by means of a pipe 16, to a small orifice 17 formed in the wall of the inlet duct 9 above the reservoir 1. Another small orifice 1 8, having a diameter of the order of 1 to 2 mm, is formed in the vertical wall 13 that separates the inlet and outlet ducts 9 and 10 from each other, this orifice 18 being level with the aperture in the top of the flask 1. The liquid level 4 in the expansion vessel 2 is at a height which lies between that of the orifice 18 and that of the lower ends of the inlet and outlet ducts 9 and 10.

When the flow of coolant fluid in the circuit stops, for example when the engine is stopped, air from the head space 5 passes through the air pipe 16 and the orifice 17 into the inlet duct 9. From there it passes through the orifice 18 into the outlet duct 10. At the same time, liquid is returned from the inlet duct 9 to the expansion vessel 2 via the pipe 14. In this way a liquid/air separation plane 19, at the same height as the fluid level 4 in the expansion vessel, is set up in the inlet and outlet ducts 9 and 10. The liquid contained in the reservoir 1 is thus physically separated from the liquid present in the remainder of the circuit, by the air which is above the plane of separation 19. In this way, any heat transfer, either by direct conduction or by convection within the liquid, between the inside of the reservoir and the outside, is avoided. This augments the insulating effect of the insulation within the double wall of the reservoir 1 by slowing the cooling of the liquid in the reservoir still further.

When the flow of the coolant fluid is resumed in the circuit, the ducts 9 and 10 are once again filled with the coolant liquid from the expansion vessel 2, via the pipe 14.

A three-way distribution valve 20, which is indicated diagrammatically in FIG. 1 in the form of a pivoting flap valve, is mounted within the plug unit 8, 9, 10. In the position indicated in full lines, the valve 20 enables the coolant fluid to enter through the inlet duct 9, and to leave via the outlet duct 10 as described above. In the position of the valve 20 shown in broken lines, the valve obturates the outlet duct 10, and opens a port 21 which puts the inlet and outlet ducts 9 and 10 into communication with each other in the vicinity of the pipe connections 11 and 12. The coolant fluid arriving in the upstream region of the inlet duct 9 therefore passes directly into the downstream region of the outlet duct 10, thus emptying the reservoir 1. This causes the mass of coolant fluid flowing in the system to be reduced in some operating modes of the apparatus, in the manner described in French patent specification No. FR 2 713 279A.

In another version, it is possible to connect the pipe 14 to the pipe connection 12, and the pipe connection 11 to the heating radiator, without any modification to the operation of the apparatus apart from changing the direction of flow of the coolant fluid in the ducts 9 and 10.

Figure 2:
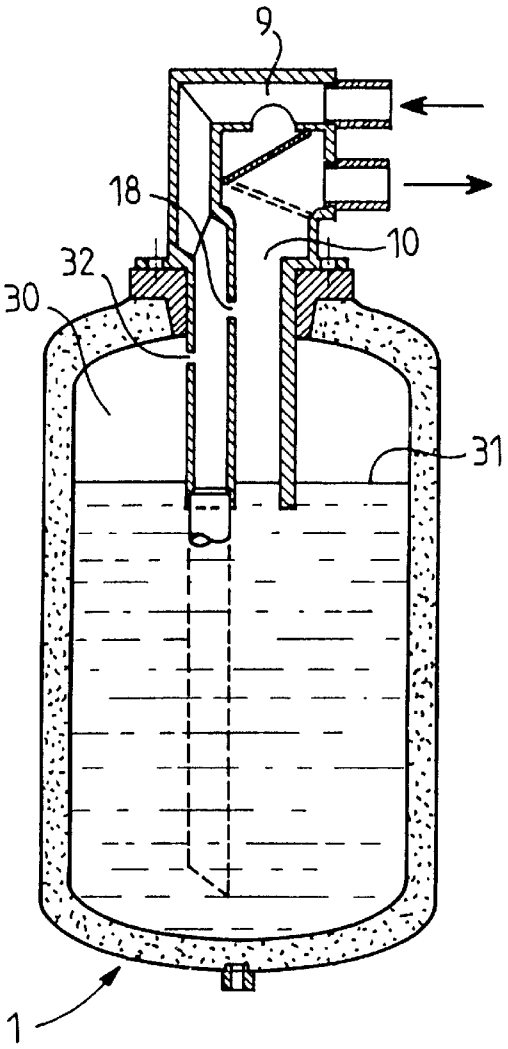

Referring now to FIG. 2, in this embodiment the insulated reservoir 1 is nearly identical to that shown in FIG. 1, but it serves at the same time as an expansion vessel, thus replacing the expansion vessel 2. The reservoir has a head space 30 containing air above a level 31, which is itself situated higher up than the lower ends of the inlet and outlet ducts 9 and 10. The orifice 17 communicating with the air pipe 16 is replaced by an orifice 32 which connects the inlet duct 9 to the head space 30. When the flow of coolant fluid stops, the inlet and outlet ducts 9 and 10 are filled with air from the head space 30, via the orifices 32 and 18.

Figure 3:
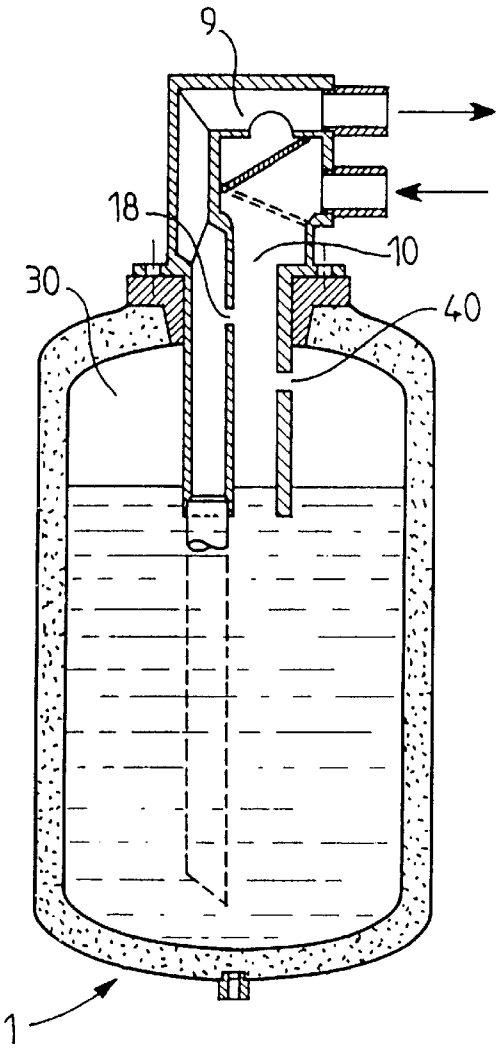

In the further embodiment shown in FIG. 3, the reservoir is different from that in FIG. 2 in that it is arranged for coolant fluid to enter via the duct 10, and to leave via the duct 9. The orifice 32 is replaced by an orifice 40 which puts the inlet duct 10 into communication with the head space 30.

Figure 4:
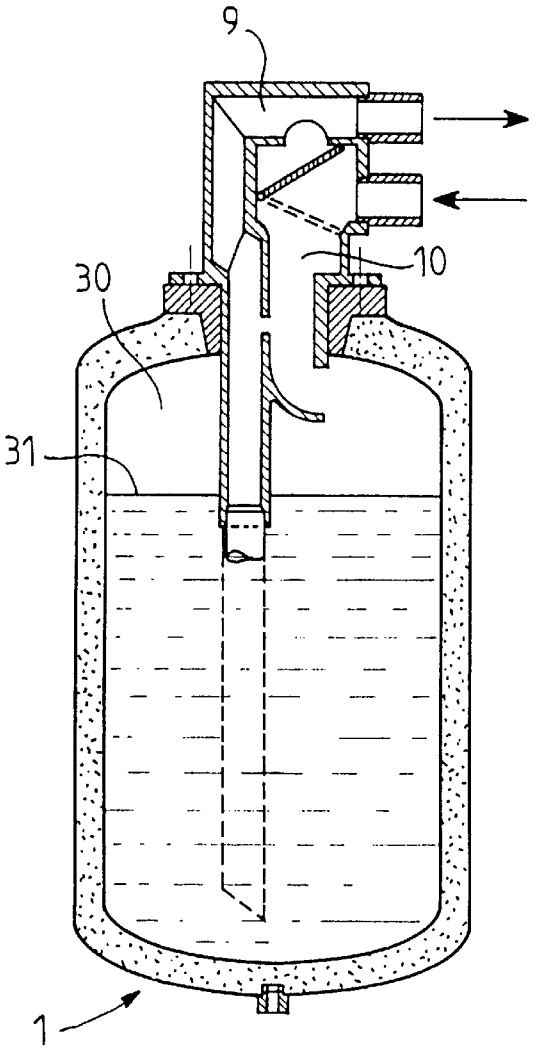
FIGS. 2 to 4 are side elevations in diametrical cross section.

Finally, in the embodiment shown in FIG. 4, the reservoir is similar to that in FIG. 3, except that the inlet duct 10 does not extend down to the liquid level 31, but instead it exhausts into the head space 20, the orifice 40 of FIG. 3 being omitted.

What is claimed is:

1. A cooling system for a heat engine cooled by a liquid coolant fluid, the system being a selectively interruptible fluid circuit including the engine and further including an extraction device for removing heat from the coolant fluid, together with flow means for circulating the fluid in the circuit, the circuit further including a thermally insulated reservoir for containing the fluid, the reservoir including an inlet duct and an outlet duct connected in the circuit, wherein the circuit comprises a component which defines a head space for expansion of the fluid therein and for permanently containing air, the inlet and outlet ducts being connected to said head space, whereby when the flow of fluid in the circuit is selectively interrupted, air from the head space is interposed in the inlet and outlet ducts between the liquid in the reservoir and the liquid in the remainder of the circuit.

2. A system according to claim 1, wherein the reservoir further comprises means defining a passage putting the inlet and outlet ducts into communication with each other, said passage avoiding any significant disturbance of the flow of the cooling fluid, one of the inlet and outlet ducts being connected to said head space, whereby said passage enables air to flow into the other one of the ducts through the first duct.

3. A system according to claim 2, wherein the inlet and outlet ducts are juxtaposed to each other, being separated by means defining a small orifice constituting said passage.

4. A system according to claim 2, wherein said one duct is the inlet duct.

5. A system according to claim 1, further comprising an expansion vessel separate from the reservoir and defining said head space within said expansion vessel, to define a liquid level within said expansion vessel, the inlet and outlet ducts being disposed at least partly above said liquid level.

6. A system according to claim 4, wherein the reservoir defines a liquid level within the reservoir, and further defines said head space above said liquid level in the reservoir, said head space being in direct communication with the inlet duct, with the outlet duct having an inlet disposed below said liquid level, said passage being located above said liquid level.

7. A system according to claim 1, wherein the reservoir further includes a vessel having a thermally insulated wall and an aperture, the reservoir further including a plug unit sealingly obturating said aperture, said plug unit having a plug and the inlet and outlet ducts fixed to said plug, the ducts extending substantially through said aperture.

8. A cooling system for a heat engine cooled by a liquid coolant fluid, the system being a selectively interruptible fluid circuit including the engine and further including an extraction device for removing heat from the coolant fluid, together with flow means for circulating the fluid in the circuit, the circuit further including a thermally insulated reservoir for containing the fluid, the reservoir including an inlet duct and an outlet duct connected in the circuit, wherein the circuit comprises a component which defines a head space for expansion of the fluid therein and for permanently containing air, the inlet and outlet ducts being connected to said head space, whereby when the flow of fluid in the circuit is selectively interrupted, air from the head space is interposed in the inlet and outlet ducts between the liquid in the reservoir and the liquid in the remainder of the circuit, wherein the reservoir further includes a vessel having a thermally insulated wall and an aperture, the reservoir further including a plug unit sealingly obturating said aperture, said plug unit having a plug and the inlet and outlet ducts fixed to said plug, the ducts extending substantially through said aperture, further including distribution valve means carried by said plug unit for selectively putting the reservoir out of circuit, whereby to diminish the quantity of fluid in circulation in the circuit.

* * * * *